US007129683B2

(12) United States Patent
Haider et al.

(10) Patent No.: US 7,129,683 B2
(45) Date of Patent: Oct. 31, 2006

(54) VOLTAGE REGULATOR WITH A CURRENT MIRROR FOR PARTIAL CURRENT DECOUPLING

(75) Inventors: Gunter Haider, Linz (AT); Gerhard Nebel, Immenstadt (DE); Iker San Sebastian, Madrid (ES); Andreas Schlaffer, Munich (DE); Uwe Weder, Hallertau (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 11/335,158

(22) Filed: Jan. 18, 2006

(65) Prior Publication Data

US 2006/0214652 A1 Sep. 28, 2006

Related U.S. Application Data

(63) Continuation of application No. PCT/DE04/01517, filed on Jul. 13, 2004.

(30) Foreign Application Priority Data

Jul. 18, 2003 (DE) ..... 103 32 864

(51) Int. Cl.
*G05F 1/565* (2006.01)

(52) U.S. Cl. ..... 323/273; 323/315

(58) Field of Classification Search ..... 323/273, 323/315, 349

See application file for complete search history.

(56) References Cited

U.S. PATENT DOCUMENTS 5,596,265 A 1/1997 Wrathall et al.
6,066,944 A 5/2000 Sakurai
6,166,530 A * 12/2000 D'Angelo ..... 323/316
6,188,211 B1 * 2/2001 Rincon-Mora et al. ..... 323/280
6,333,623 B1 12/2001 Heisley et al.
6,522,111 B1 * 2/2003 Zadeh et al. ..... 323/277
6,867,573 B1 * 3/2005 Carper ..... 323/277
6,969,982 B1 * 11/2005 Caldwell ..... 323/313
2002/0027470 A1 3/2002 Narendra et al.
2003/0111986 A1 6/2003 Xi

FOREIGN PATENT DOCUMENTS

DE 699 01 856 T2 1/2003
EP 0 945 774 A1 9/1999
EP 1 079 294 A1 2/2001

* cited by examiner

*Primary Examiner*—Jeffrey Sterrett
(74) *Attorney, Agent, or Firm*—Dockstein, Shapiro, LLP.

(57) ABSTRACT

A voltage regulator having a current mirror for decoupling a partial current icluding a first NMOS transistor as a series transistor. In addition, the voltage regulator has a second NMOS transistor, which forms a current mirror with the first NMOS transistor. Furthermore, in the case of the voltage regulator, the first NMOS transistor is connected in series with a first PMOS transistor and a third transistor. The second NMOS transistor is likewise connected in series with a second PMOS transistor and a fourth transistor, the control inputs of the first and second PMOS transistors being connected to one another and the control inputs of the third and fourth transistors being connected to a control terminal for setting the magnitude of the partial current to be decoupled.

10 Claims, 2 Drawing Sheets

VOLTAGE REGULATOR WITH A CURRENT MIRROR FOR PARTIAL CURRENT DECOUPLING

CROSS-REFERENCE TO RELATED APPLICATION

This application is a continuation of International Patent Application Serial No. PCT/DE2004//001517, filed Jul. 13, 2004, which published in German on Feb. 3, 2005 as WO 2005/010631, and is incorporated herein by reference in its entirety.

FIELD OF THE INVENTION

The invention relates to a voltage regulator having a current mirror for decoupling a partial current. The decoupled partial current can then be compared for example with a reference current in order to ascertain whether the load current supplied by the voltage regulator still lies within the permissible range. The partial current can thus contribute to realizing a current limiter in the voltage regulator.

BACKGROUND OF THE INVENTION

Nowadays the on-chip operating voltages are generally lower than the voltage applied externally to the chip. Therefore, integrated voltage regulators are required on the chip in order to reduce the external voltage. Said voltage regulators may be based on an n-channel MOS technology, by way of example. In order to be able to sufficiently increase the voltage at the gate of the output transistor—embodied as an NMOS transistor—of the voltage regulator, such series regulators additionally have a charge pump. In comparison with a PMOS transistor, an NMOS transistor as output transistor advantageously affords a better suppression of the input voltage and a lower sensitivity in the event of load fluctuations. These voltage regulators may be formed as three-point regulators, for example, although the voltage at the output of the voltage regulator has a certain ripple. With the aid of a continuous regulator, however, this ripple can be reduced and the voltage regulation can thus be improved. In principle, such circuits, which are also known by the designation low-drop voltage regulators, are designed for a particularly low voltage drop between input and output.

For various reasons and inter alia also because mirroring out or decoupling a partial current is beset with considerable difficulties in the case of a voltage regulator having an NMOS series transistor, hitherto use has been made exclusively of voltage regulators having a PMOS output transistor. In the case of a voltage regulator having a PMOS output transistor, a partial current of the total supply current can be decoupled through simple supplementary connection of a current mirror transistor.

In principle, it is a prerequisite for a current mirror that both transistors, that is to say the transistors P1 and P2 in the exemplary embodiment shown in FIG. 1, see the same control voltage between gate and source. That is to say that the voltage drop UGS between gate and source must be identical in magnitude in the case of both transistors P1 and P2. If the two gate terminals of the two transistors P1 and P2 are then connected to one another, a current mirror arises, the magnitude of the mirrored-out current I2 being determined from the ratio of channel width of the first transistor P1 to channel width of the second transistor P2.

FIG. 1 shows a corresponding current mirror having PMOS transistors as can be used in the case of the aforementioned voltage regulator having a PMOS output transistor. The current mirror comprises a first PMOS transistor P1, which is also simultaneously the series transistor of the voltage regulator, and a second PMOS transistor P2. The two source terminals of the first and second PMOS transistors P1 and P2 are connected to one another. An external supply voltage VDDEXT is present at them. The gate terminals of the two PMOS transistors P1 and P2 are likewise connected to one another. The two transistors P1 and P2 are controlled via the common gate thereby formed. Since the ratio of the channel widths of the two PMOS transistors P1 and P2 is 1:1000, the partial current I2 mirrored out via the second PMOS transistor P2 amounts to $1/1000$ of the load current I1 flowing via the first PMOS transistor P1. Consequently, I2=I1:1000 holds true to a first approximation.

SUMMARY OF THE INVENTION

It is an object of the invention to specify a voltage regulator having a current mirror for decoupling a partial current in which the voltage regulator has an NMOS transistor as a series transistor.

The voltage regulator of the present invention has a current mirror for decoupling a partial current. The voltage regulator also has a first NMOS transistor as a voltage regulator transistor, wherein the first NMOS transistor is connected in series with a first PMOS transistor and a third transistor, and a second NMOS transistor, which forms a current mirror with the first NMOS transistor, wherein the second NMOS transistor is connected in series with a second PMOS transistor and a fourth transistor. The control inputs of the first and second PMOS transistors are connected to one another. The control inputs of the third and fourth transistors are connected to a control terminal for setting the magnitude of the partial current to be decoupled.

BRIEF DESCRIPTION OF THE DRAWINGS

The invention is explained in more detail below by means of a plurality of exemplary embodiments with reference to four figures.

DETAILED DESCRIPTION OF PREFERRED EMBODIMENTS OF THE INVENTION

Figure 1:
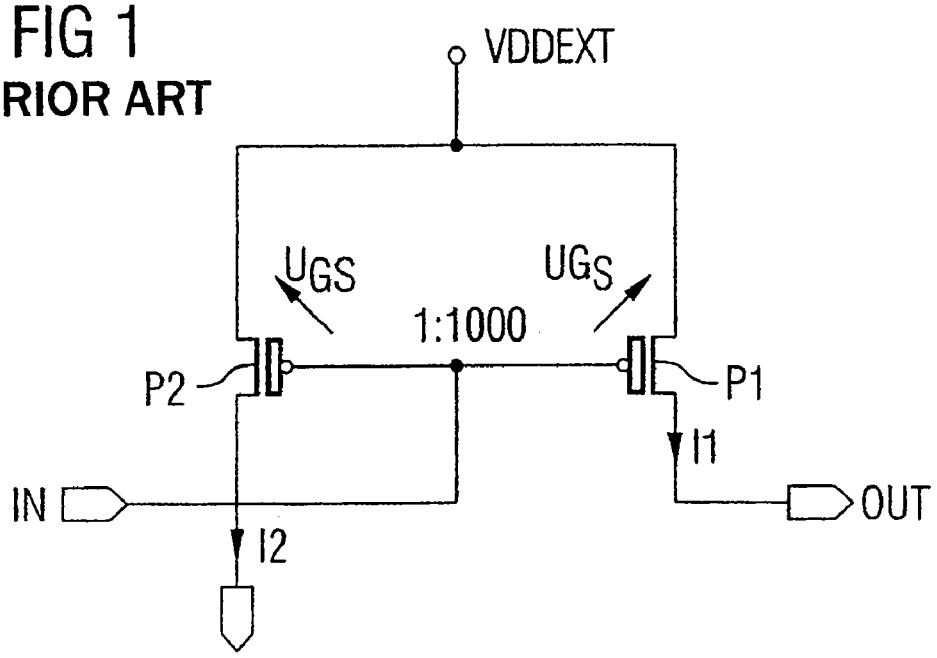
FIG 1 PRIOR ART
FIG. 1 shows the construction of a current mirror having two PMOS transistors.

The voltage regulator of the present invention has a current mirror for decoupling a partial current. The voltage regulator also has a first NMOS transistor as a voltage regulator transistor, wherein the first NMOS transistor is connected in series with a first PMOS transistor and a third transistor, and a second NMOS transistor, which forms a current mirror with the first NMOS transistor, wherein the second NMOS transistor is connected in series with a second PMOS transistor and a fourth transistor. The control inputs of the first and second PMOS transistors are connected to one another. The control inputs of the third and fourth transistors are connected to a control terminal for setting the magnitude of the partial current to be decoupled.

In one embodiment of the voltage regulator according to the invention, provision is additionally made of a capacitor connected between the control outputs of the first and second PMOS transistors. This has the advantage that even fast transient voltage changes caused for example by a load change at the output of the voltage regulator can thereby likewise be taken into account.

In an additional embodiment of the voltage regulator according to the invention, the first PMOS transistor forms a diode. Moreover, the first and second PMOS transistors may advantageously be dimensioned in a manner identical in magnitude.

The fourth transistor of the voltage regulator according to the invention advantageously forms a diode. Moreover, the third and fourth transistors may be dimensioned in a manner identical in magnitude.

Furthermore, in the case of the voltage regulator according to the invention, the third and fourth transistors may be formed as NMOS transistors.

In order to achieve the object, it is furthermore proposed that the voltage regulator according to the invention has a comparison signal output, which is connected to the control output of the second PMOS transistor, in order to make available a signal forming the result of a comparison between a reference current that can be applied to the control terminal and the partial current. The comparison signal thus formed may be used as a control signal for a current limiter.

As an alternative to this, in the case of the voltage regulator according to the invention, the first NMOS transistor may be connected in series with a third PMOS transistor and a fifth transistor. The voltage regulator additionally has a comparison signal output, which is connected to the control output of the third PMOS transistor, in order to make available a signal forming the result of a comparison between a reference current that can be applied to the control terminal and the partial current. The comparison signal thus formed may be used as a control signal for a current limiter.

In one development of the voltage regulator according to the invention, the drain terminals of the first and second NMOS transistors are connected to one another.

According to a further feature of the invention, the voltage regulator may be formed as a series regulator and comprise a charge pump connected to the control inputs of the first and second NMOS transistors.

Finally, the voltage regulator according to the invention may be formed as a low drop voltage regulator. This has the advantage that the voltage drop between the input and the output of the voltage regulator is extremely low.

The current mirror having two PMOS transistors which is shown in FIG. 1 is not discussed any further below, rather reference is made to the introduction to the description.

Figure 2:
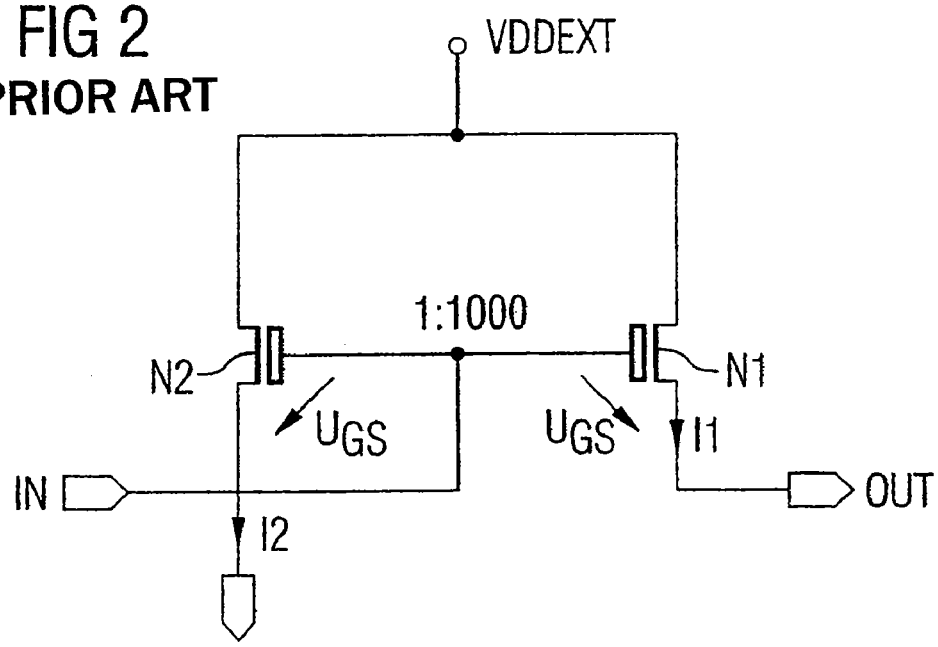
FIG 2 PRIOR ART
FIG. 2 shows the basic principle of a current mirror constructed with two NMOS transistors.

FIG. 2 shows the basic principle of a current mirror having two NMOS transistors N1 and N2. The drain terminals of the NMOS transistors N1 and N2 are connected to one another and are connected to the external voltage VDDEXT. In order that the circuit shown in FIG. 2 operates as a current mirror, the source terminals and the gate terminals of the two transistors N1 and N2 have to be connected or be at the same potentials in each case. If the two source terminals of the transistors N1 and N2 are connected to one another, the desired partial current can only be tapped off at the drain of the transistor N2 and, in order to be able to compare it with a reference current, would have to be mirrored downward once again by means of PMOS transistors. However, this would necessitate a higher voltage than the external operating voltage VDDEXT. The second possibility, namely of bringing the two source terminals of the transistors N1 and N2 to the same potential, is employed in the case of the circuit described in FIG. 3.

Figure 3:
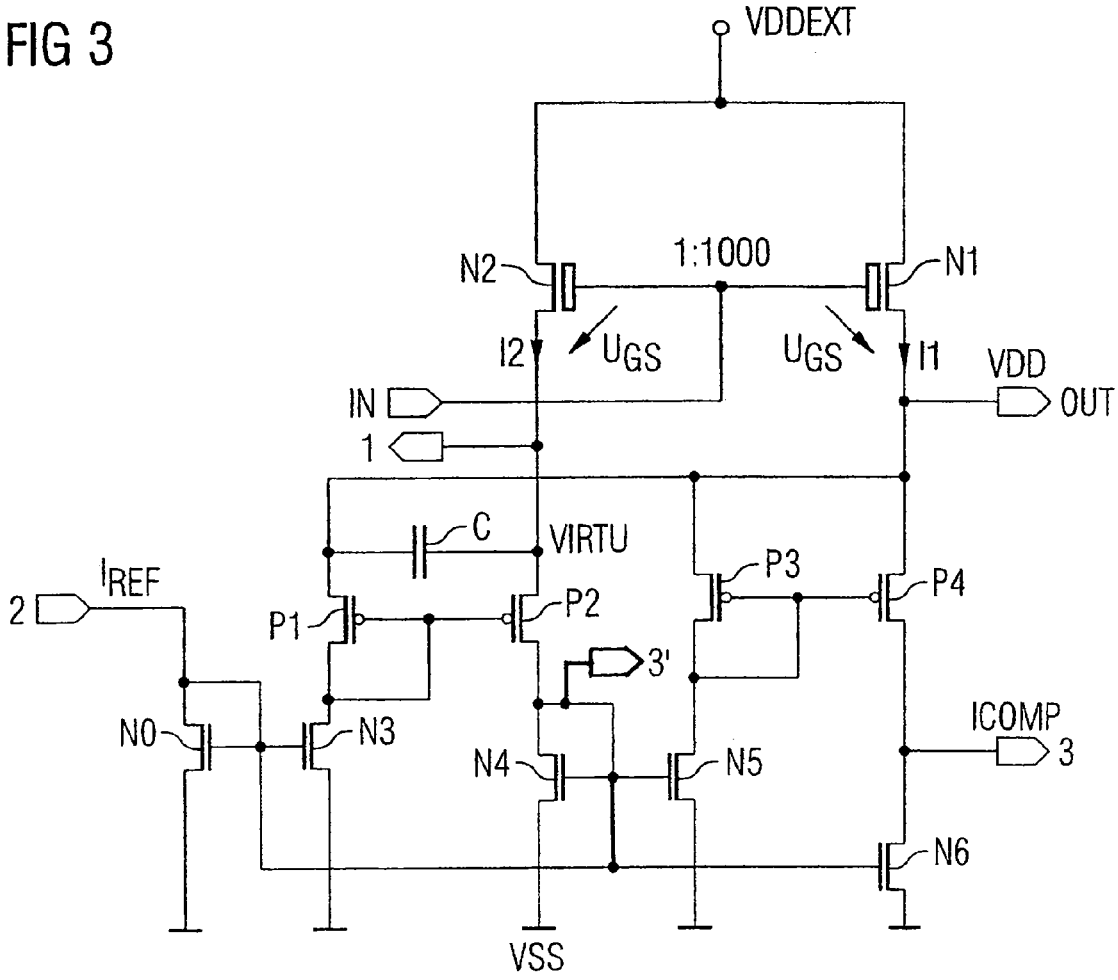
FIG. 3 shows a circuit in which a current mirror having NMOS transistors is used.

The circuit shown in FIG. 3 has a current mirror having the two NMOS transistors N1 and N2 and also a comparison unit for comparing the mirrored-out partial current I2 with a reference current IREF. In this case, the circuit described has the advantage that the desired partial current I2 can be mirrored out despite a very small voltage difference between the input and the output of the voltage regulator. This cannot be achieved with the aid of a PMOS current mirror additionally connected into the supply path. As already mentioned further above, a current mirror arises when the gate-source voltages UGS of two NMOS transistors are identical in magnitude. The simplest way of achieving this is by connecting the gate and the source terminals of the two transistors to one another. In this case, the input and the output of the current mirror are then situated on the drain side of the transistors. In the case of a voltage regulator having NMOS transistors, however, the output of the partial current must lie on the source side of the NMOS transistors, with the result that the two source terminals cannot simply be connected to one another. Otherwise it would no longer be possible to distinguish between input and output.

The invention solves the problem by ensuring that the same potential is present at the source terminals of the two NMOS transistors N1 and N2 without the source terminals being fixedly connected to one another. For this purpose, it is ensured with the aid of a PMOS cascode circuit that the source of the NMOS transistor N2 that decouples the desired partial current I2 is at the same potential as the source of the NMOS transistor N1 that forms the main transistor. With the aid of an evaluation unit connected downstream, it is possible to effect a comparison between the decoupled or mirrored-out partial current I2 and a reference current IREF.

In the case of the circuit shown in FIG. 3, the current mirror has, as mentioned, the two NMOS transistors N1 and N2, which are connected to one another on the drain side and are connected to the external operating voltage VDDEXT. The two gate terminals of the NMOS transistors N1 and N2 are likewise connected to one another and lead to a control input IN, via which the current mirror can be controlled. In the exemplary embodiment shown, the channel width ratio of the two transistors N2 and N1 is 1:1000. As a result, a partial current I2 which is 1/1000 of the current I1 flowing through the first NMOS transistor N1 can be mirrored out and be tapped off at the output 1 of the current mirror. In this case, the current I1 corresponds to the load current made available by a voltage regulator at its output OUT. The first NMOS transistor N1 forms a series circuit with a first PMOS transistor P1 and a further NMOS transistor N3. A further series circuit is formed by the transistor N2, a second PMOS transistor P2 and a fourth NMOS transistor N4. The first PMOS transistor P1 operating as a diode is connected on the gate side to the gate of the second PMOS transistor P2, which is preferably dimensioned identically. A capacitor C is additionally connected between the source terminals of the first and second PMOS transistors P1 and P2.

In a simplified embodiment of the circuit, which is identified by the dashed lines, the input 2, to which a reference current IREF can be applied, is connected to the gate terminals of the third and fourth NMOS transistors N3 and N4. What is achieved with the aid of this part of the circuit, namely the transistors P1, N3, P2 and N4, is, on the one hand, that the source terminals of the two NMOS transistors N2 and N1 are at the same potential. On the other hand, at an output 3', which is likewise identified by dashed lines in FIG. 3, it is possible to tap off a comparison signal that specifies whether the mirrored-out partial current I2 is greater or less than the reference current IREF. For the case where the mirrored-out partial current I2 is greater than the reference current IREF, the signal with a positive level, which corresponds to the high logic state, is present at the output 3', which is also referred to as the comparison signal output. However, if the mirrored-out partial current I2 is less than the reference current IREF, a signal with a voltage corresponding approximately to the operating potential VSS and thus to the low logic level is present at the output 3'.

In the second possible embodiment of the circuit, which is likewise shown in FIG. 3, instead of the output 3' the output 3 is used in order to tap off the result of the comparison between the mirrored-out partial current I2 and the reference current IREF in the form of a comparison signal ICOMP. For this purpose, the circuit has two further PMOS transistors P3 and P4 and also two further NMOS transistors N5 and N6, the third PMOS transistor P3 forming a first series circuit with the fifth NMOS transistor N5 and the fourth PMOS transistor P4 forming a second series circuit with the sixth NMOS transistor N6. Moreover, the gate of the third PMOS transistor P3 operating as a diode is connected to the gate of the fourth PMOS transistor P4. In this exemplary embodiment, the terminal 2 of the circuit is not connected to the gate of the fourth NMOS transistor N4, but rather to the gate of the sixth NMOS transistor N6.

Figure 4:
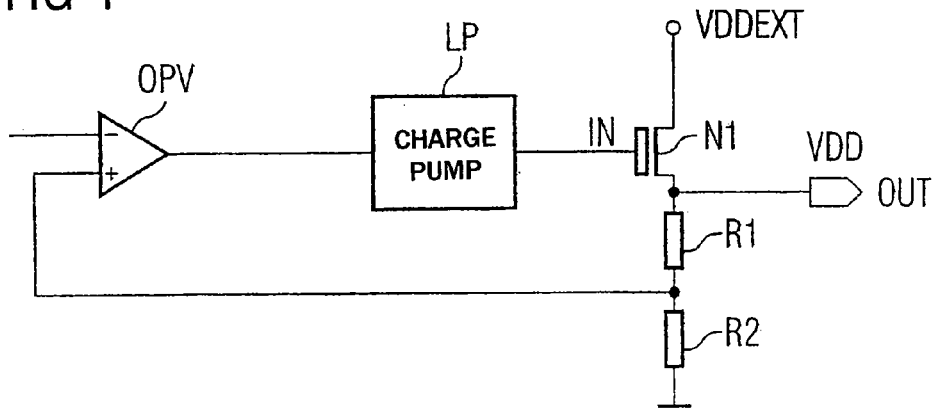
FIG. 4 shows the basic construction of a voltage regulator having an NMOS transistor as a series transistor, the NMOS transistor additionally being part of the current mirror.

The functioning of the circuit is described in more detail below. The common gate of the two NMOS transistors N1 and N2 is driven by a voltage regulator, which may be formed for example as shown in FIG. 4, in such a way that the desired regulated voltage VDD can be tapped off at the output OUT. The voltage VDD–Vthp, where the voltage Vthp corresponds to the diode voltage of the first PMOS transistor P1, is present at the gate of the two PMOS transistors P1 and P2. The second PMOS transistor P2 operates as a source follower or cascode transistor and ensures that the same potential as at the output OUT is present at the node VIRTU provided that the currents through the two PMOS transistors P1 and P2 are identical in magnitude. This is also the case in the region of the switching point of the current comparator formed by the two transistors P4 and N6. The capacitance C ensures that even fast transient voltage changes caused by a load change at the output OUT are transferred to the node VIRTU as well as possible. Via the NMOS transistor N0 operating as a diode, the current IREF is mirrored in to the two transistors N3 and N6. In this case, the current IREF represents the desired value at which the current limiting of the voltage regulator is intended to respond taking account of the mirror ratio of the transistors N1 and N2. As long as the partial current I2 decoupled at the transistor N2 is less than the reference current IREF, a smaller current also flows via the transistors N4, N5, P3 and P4 and via the transistor N6. The comparison signal ICOMP at the output 3 is then at the reference potential VSS. If the decoupled partial current I2 becomes greater than the reference current IREF, the transistor P4, with respect to the transistor N6, pulls the voltage in the direction of the external operating voltage VDDEXT, so that the level of the comparison signal ICOMP lies in the region of the output voltage VDD. This indicates that the predetermined current IREF was exceeded.

The circuit in accordance with FIG. 3 may be part of the voltage regulator shown in FIG. 4. In this case, the first NMOS transistor N1 forms both the series transistor of the voltage regulator and the main transistor of the current mirror. The voltage regulator shown in FIG. 4 is formed as a series regulator. In this case, by means of a regulating operational amplifier OPV, a desired voltage is compared with a partial voltage formed by a voltage divider, comprising the resistors R1 and R2, and the comparison result is passed to a charge pump LP. The latter in turn drives the first NMOS transistor N1 correspondingly.

The above description of the exemplary embodiments according to the present invention serves only for illustrative purposes and not for the purpose of restricting the invention. Various changes and modifications are possible in the context of the invention without departing from the scope of the invention and its equivalents.

What is claimed is:

1. A voltage regulator having a current mirror for decoupling a partial current, the voltage regulator comprising:

a first NMOS transistor as a voltage regulator transistor, wherein the first NMOS transistor is connected in series with a first PMOS transistor and a third transistor; and a second NMOS transistor, which forms a current mirror with the first NMOS transistor, wherein the second NMOS transistor is connected in series with a second PMOS transistor and a fourth transistor, wherein the control inputs of the first and second PMOS transistors are connected to one another, and wherein the control inputs of the third and fourth transistors are connected to a control terminal for setting the magnitude of the partial current to be decoupled.

2. The voltage regulator as claimed in claim 1, further comprising a capacitor connected between the controlled outputs of the first and second PMOS transistors.

3. The voltage regulator as claimed in claim 1, wherein the first PMOS transistor forms a diode.

4. The voltage regulator as claimed in claim 1, wherein the fourth transistor forms a diode.

5. The voltage regulator as claimed in claim 1, wherein the third and fourth transistors are formed as NMOS transistors.

6. The voltage regulator as claimed in claim 1, further comprising a comparison signal output, which is connected to the controlled output of the second PMOS transistor, in order to make available a signal forming a result of a comparison between a reference current that can be applied to the control terminal and the partial current.

7. The voltage regulator as claimed in claim 1, wherein the first NMOS transistor is connected in series with a third PMOS transistor and a sixth transistor, and wherein the voltage regulator further comprises a comparison signal output, which is connected to the controlled output of the third PMOS transistor, in order to make available a signal forming a result of a comparison between a reference current that can be applied to the control terminal and the partial current.

8. The voltage regulator as claimed in claim 1, wherein the drain terminals of the first and second NMOS transistors are connected to one another.

9. The voltage regulator as claimed in claim 1, wherein the voltage regulator is formed as a series regulator and comprises a charge pump connected to the control inputs of the first and second NMOS transistors.

10. The voltage regulator as claimed in claim 1, wherein the voltage regulator is formed as a low-drop voltage regulator.

* * * * *

UNITED STATES PATENT AND TRADEMARK OFFICE

CERTIFICATE OF CORRECTION

PATENT NO. : 7,129,683 B2
APPLICATION NO. : 11/335158
DATED : October 31, 2006
INVENTOR(S) : Gunter Haider et al.

It is certified that error appears in the above-identified patent and that said Letters Patent is hereby corrected as shown below:

On the Cover Page: Item

(74) Attorney, Agent, or Firm — "Dockstein, Shapiro, LLP" should read --Dickstein Shapiro LLP--

In the Abstract:

Line 2, "icluding" should read --including--

Signed and Sealed this

Thirtieth Day of January, 2007

JON W. DUDAS
*Director of the United States Patent and Trademark Office*